US006929326B2

(12) United States Patent
Cohen-Fyffe

(10) Patent No.: US 6,929,326 B2
(45) Date of Patent: Aug. 16, 2005

(54) CLEAN DINER HIGH CHAIR SEAT COVER

(76) Inventor: Melissa Cohen-Fyffe, 77 Jericho Rd., Pelham, NH (US) 03076

( * ) Notice: Subject to any disclaimer, the term of this patent is extended or adjusted under 35 U.S.C. 154(b) by 0 days.

(21) Appl. No.: 10/773,395

(22) Filed: Feb. 6, 2004

(65) Prior Publication Data

US 2005/0012366 A1 Jan. 20, 2005

Related U.S. Application Data

(60) Provisional application No. 60/445,566, filed on Feb. 6, 2003.

(51) Int. Cl.[7] ..... A47C 31/11; A47D 1/10

(52) U.S. Cl. ..... 297/219.12; 297/256.17

(58) Field of Search ..... 297/219.12, 256.17

(56) References Cited

U.S. PATENT DOCUMENTS

| | | | | |
|---|---|---|---|---|
| 1,538,538 | A | 5/1925 | Wood | |
| 2,652,183 | A | 9/1953 | Hlivka | |
| D283,475 | S | 4/1986 | Reece | |
| D315,993 | S | 4/1991 | Wenderoth | |
| D383,636 | S | 9/1997 | Harris | |
| 5,678,888 | A | 10/1997 | Sowell et al. | |
| 6,129,417 | A * | 10/2000 | Cohen-Fyffe | 297/219.12 |
| 6,142,565 | A | 11/2000 | Reider | |
| 6,237,998 | B1 * | 5/2001 | Aprile | 297/219.12 |
| 6,428,098 | B1 | 8/2002 | Allbaugh | |
| D465,959 | S | 11/2002 | Cameron | |
| 6,491,996 | B2 | 12/2002 | Digangi | |
| D477,174 | S | 7/2003 | Wade | |
| D477,717 | S | 7/2003 | Gillenwater | |
| 6,676,210 | B1 | 1/2004 | Peyton | |
| 6,702,381 | B2 | 3/2004 | Endicott et al. | |
| 2002/0060480 | A1 | 5/2002 | Catelli | |
| 2003/0042775 | A1 | 3/2003 | Hunter et al. | |
| 2005/0057080 | A1 * | 3/2005 | Collins | 297/219.12 |

* cited by examiner

*Primary Examiner*—Rodney B. White
(74) *Attorney, Agent, or Firm*—James A. Sheridan; Dahl & Osterloth, LLP

(57) ABSTRACT

A high chair clean seat is disclosed for use as a seat cover on a restaurant high chair for the purpose of protecting babies and toddlers from the dirt and bacteria left on the restaurant high chair. The high chair clean seat includes a continuous connected sleeve covering the entire seating area of a high chair including the sides, back, front, corners and seat bottom with leg openings provided for legs to slide through. The high chair clean seat also comprises a strap and buckle for helping babies and toddlers sit more securely without using the soiled strap/buckle already found on restaurant high chairs. The strap/buckle system secures to the high chair by means of a small button-hole/slit on the bottom of each side of the high chair clean seat.

22 Claims, 7 Drawing Sheets

CLEAN DINER HIGH CHAIR SEAT COVER

REFERENCE TO PENDING PRIOR PATENT APPLICATION

This patent application claims benefit of pending prior U.S. Provisional Patent Application Ser. No. 60/445,566, filed Feb. 6, 2003 by Melissa Cohen-Fyffe for CLEAN DINER HIGH CHAIR COVER, which patent application is hereby incorporated herein by reference.

FIELD OF THE INVENTION

This invention is related to chair covering apparatus and methods in general, and more particularly to apparatus and methods for covering restaurant high chairs for babies and toddlers.

BACKGROUND OF THE INVENTION

There is a growing demand for cleaner public eating environments. However, no convenient systems are presently used for sanitizing the high chairs in restaurants. As such, babies and toddlers are forced to sit in previously soiled seats when dining at restaurants. The high chair seat cover of the present invention provides a novel solution to soiled restaurant high chairs.

SUMMARY OF THE INVENTION

The high chair seat cover of the present invention provides a barrier system for a high chair so as to cover the entire seating area. This includes the front, rear, each of the sides, and the corner portions. This configuration keeps restaurant high chair germs and grime away from babies and toddlers. The high chair seat cover of the present invention is a unitary design which also allows rapid installation.

An object of the invention is to provide a seat cover for creating a temporary clean environment for babies and toddlers in a restaurant high chair.

Another object of the invention is to provide a one-piece seat cover for rapid installation on a restaurant high chair.

A further object of the invention is to provide a seat cover having a continuous connected plication for covering the front seating portion, the rear seating portion, each of the side seating portions, and the upper portions of each high chair leg so as to cover the entire seating area, leaving no portion of the high chair's surface exposed to a baby's hands or skin.

A still further object is to provide a seat cover with a unitary cover having additional fasteners for adjustability.

A still further object is to provide a simple method for covering the entire seating area of a high chair including the front seating portion, the rear seating portion, each of the side seating portions, and the upper portion of each high chair leg.

With the above and other objects in view, as will hereinafter appear, there is provided a high chair clean seat for use as a seat cover on a high chair, the high chair clean seat comprising a central portion having a longitudinal axis and a lateral axis, the central portion configured to cover a center seating portion of the high chair, and a continuous plication surrounding the central portion, the continuous plication having a front portion and a back portion extending from the central portion in opposite directions away from one another and parallel to the longitudinal axis, the continuous plication having a first side portion and a second side portion extending from the central portion in opposite directions away from one another and in a direction parallel to the lateral axis, and the continuous plication configured to cover an entire seating area surrounding the center seating portion of the high chair.

In accordance with a further feature of the invention there is provided a method for covering an entire seating area of a high chair, the method comprising providing a high chair clean seat for use as a seat cover on the high chair, the high chair clean seat comprising a central portion having a longitudinal axis and a lateral axis, the central portion configured to cover a center seating portion of the high chair, and a continuous plication surrounding the central portion, the continuous plication having a front portion and a back portion extending from the central portion in opposite directions away from one another and parallel to the longitudinal axis, the continuous plication having a first side portion and a second side portion extending from the central portion in opposite directions away from one another and in a direction parallel to the lateral axis, and the continuous plication configured to cover the entire seating area of the high chair, positioning the high chair clean seat on the entire seating area of the high chair by placing the central portion, the front portion of the continuous plication, the back portion of the continuous plication, the first side portion of the continuous plication, and the second side portion of the continuous plication over the center seating portion of the high chair, a front portion of the high chair, a back portion of the high chair, a first side portion of the high chair, and a second side portion of the high chair, respectively, so as to cover the entire seating area of the high chair with the high chair clean seat.

The above and other features of the invention, including various novel details of construction and combinations of parts and method steps will now be more particularly described with reference to the accompanying drawings and pointed out in the claims. It will be understood that the particular devices and method steps embodying the invention are shown by way of illustration only and not as limitations of the invention. The principles and features of this invention may be employed in various and numerous embodiments without departing from the scope of the invention.

BRIEF DESCRIPTION OF THE DRAWINGS

These and other objects and features of the present invention will be more fully disclosed or rendered obvious by the following detailed description of the preferred embodiments of the invention, which are to be considered together with the accompanying drawings wherein like numbers refer to like parts, and further wherein.

DETAILED DESCRIPTION OF THE PREFERRED EMBODIMENTS

Figure 1:
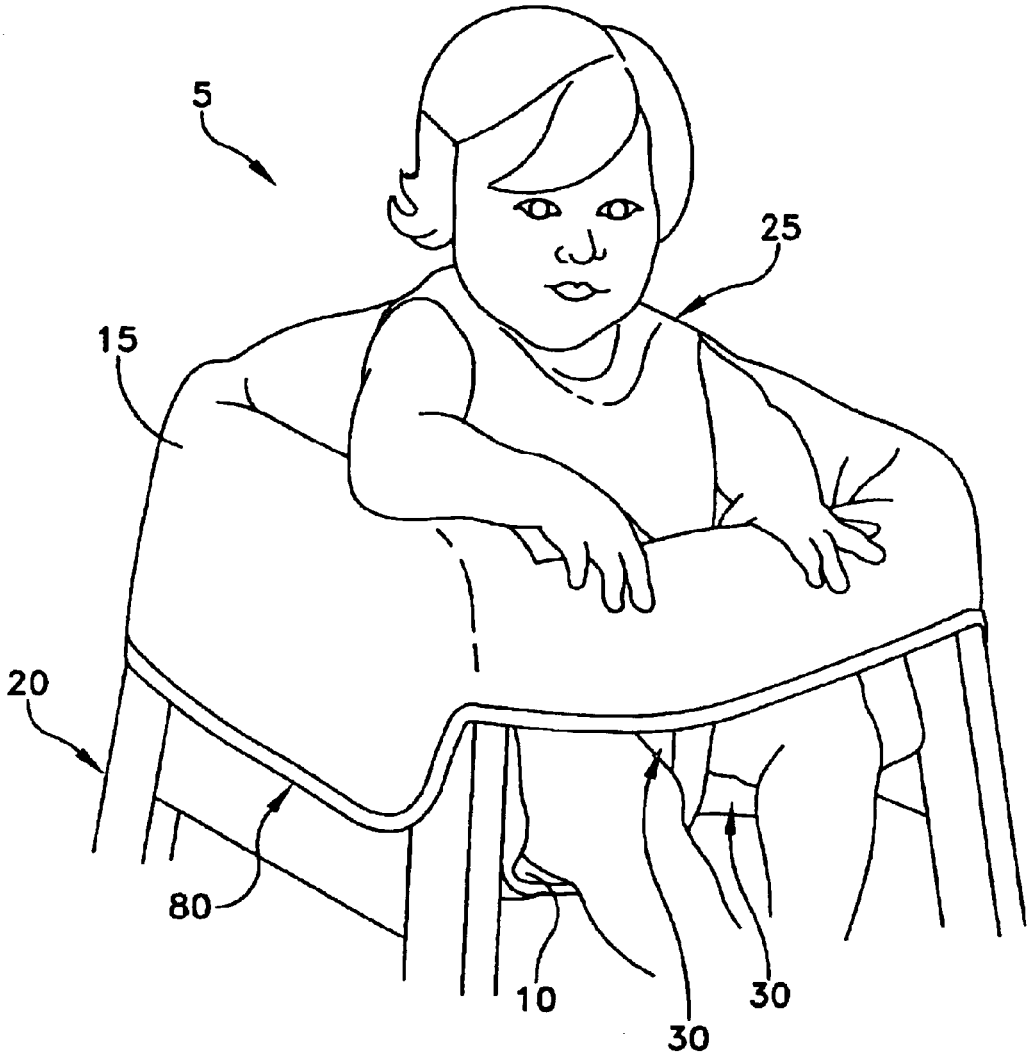
FIG. 1 is a perspective view of one form of a high chair seat cover, illustrative of a preferred embodiment of the present invention.

Looking at FIG. 1, and in a preferred embodiment of the present invention, there is shown a novel high chair seat cover 5 comprising a central portion 10 and a continuous plication 15 surrounding central portion 10. Continuous plication 15 preferably comprises a generally rectangular or square outer perimeter so as to fit over and surroundingly cover the entire seating area of the high chair. The one-piece construction of seat cover 5 provides a barrier to the seating portions of a restaurant high chair 20 that a baby or toddler 25 would otherwise contact. Leg openings 30 are provided through high chair seat cover 5 to allow toddler 25 to sit comfortably with his or her legs therethrough.

Figure 2:
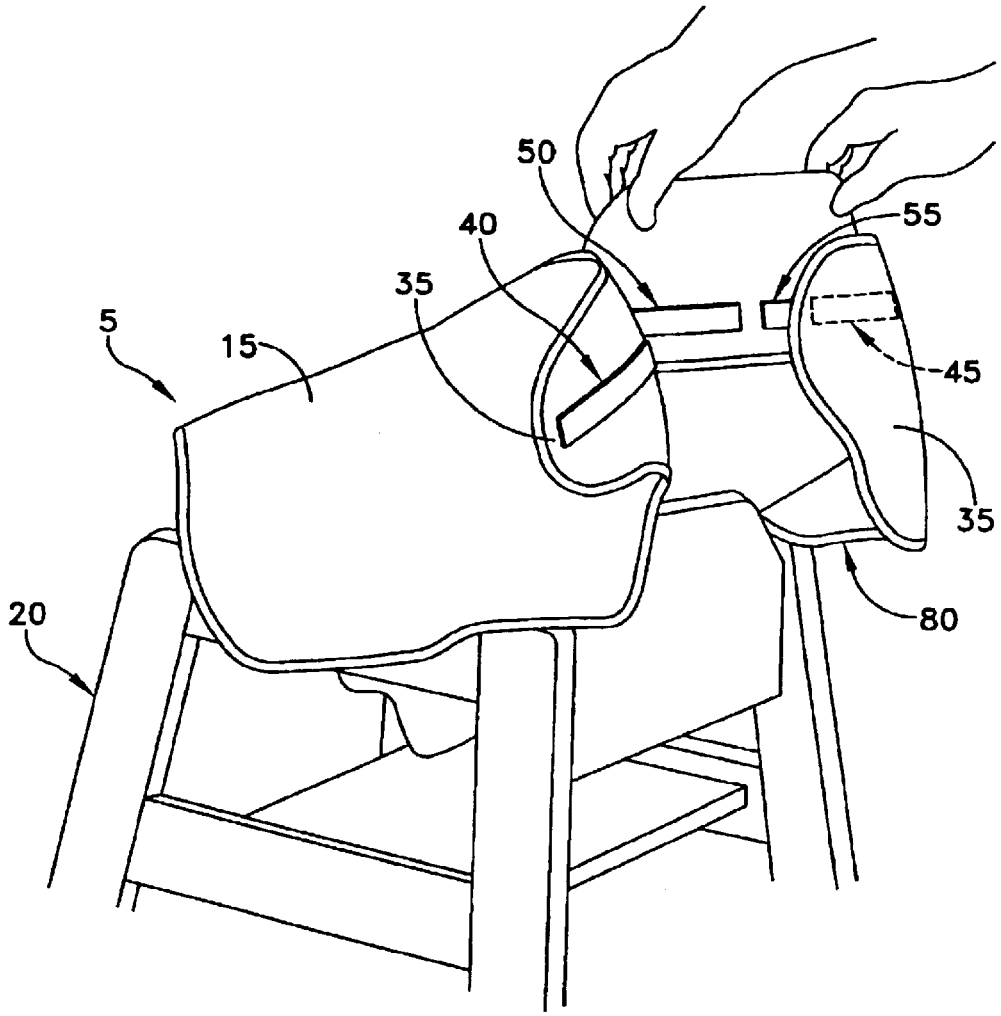
FIG. 2 is a another perspective view illustrating Velcro® hook and loop fasteners disposed on the two rear adjustment tabs of the high chair seat cover shown in FIG. 1.

Referring now to FIG. 2, and in a preferred embodiment of the present invention, there is shown a pair of horizontal adjustment flaps 35 for selectively adjusting the peripheral length of continuous plication 15 so as to conform with the periphery of high chair 20. A first portion of Velcro® hook and loop fasteners 40, 45 are disposed on horizontal adjustment flaps 35. A second portion of Velcro hook and loop fasteners 50, 55, which correspond to the first portion of fasteners 40, 45, respectively, are disposed on a rear portion of continuous sleeve 15. High chair seat cover 5 is adjustably secured to high chair 20 by attaching fastener 40 and fastener 50 together and attaching fastener 45 and fastener 55 together. Horizontal adjustment flaps 35 are selectively positionable to fit both narrow and wide high chair configurations.

Figure 3:
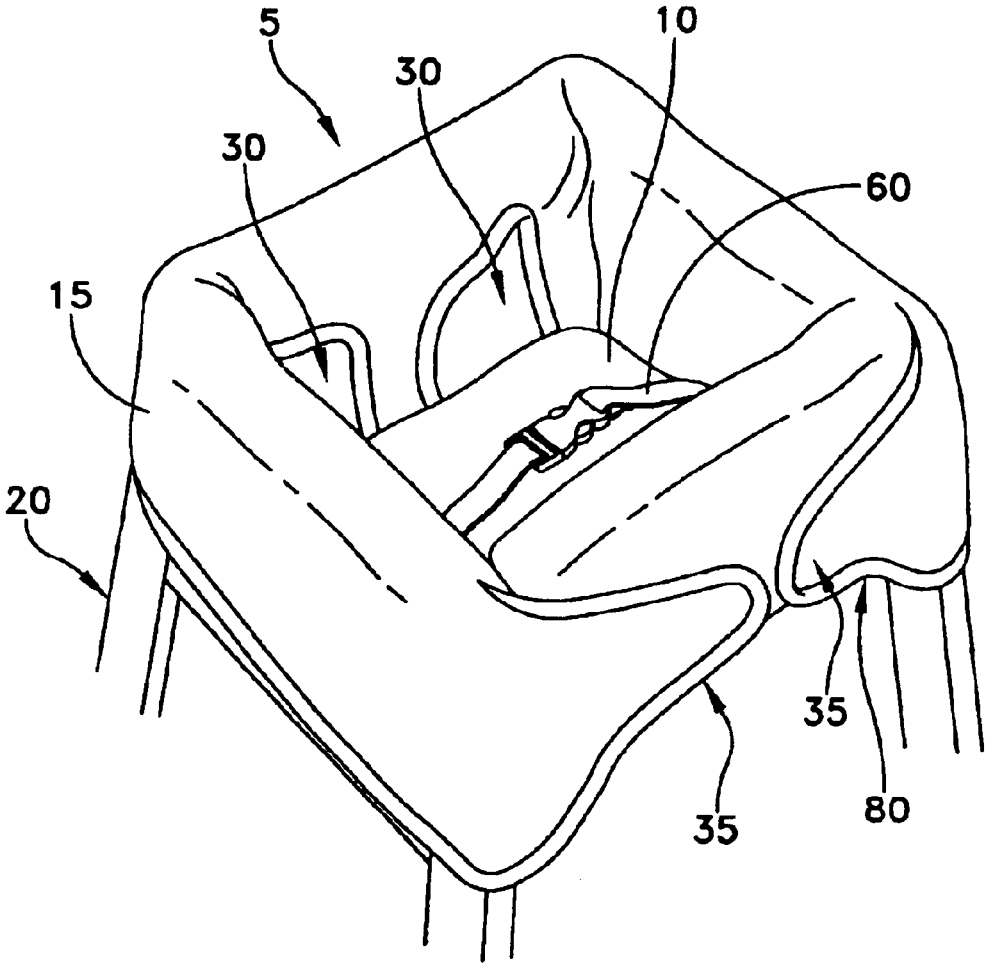
FIG. 3 is a perspective view illustrating a safety belt configured on the high chair seat cover shown in FIG. 1.
Figure 4:
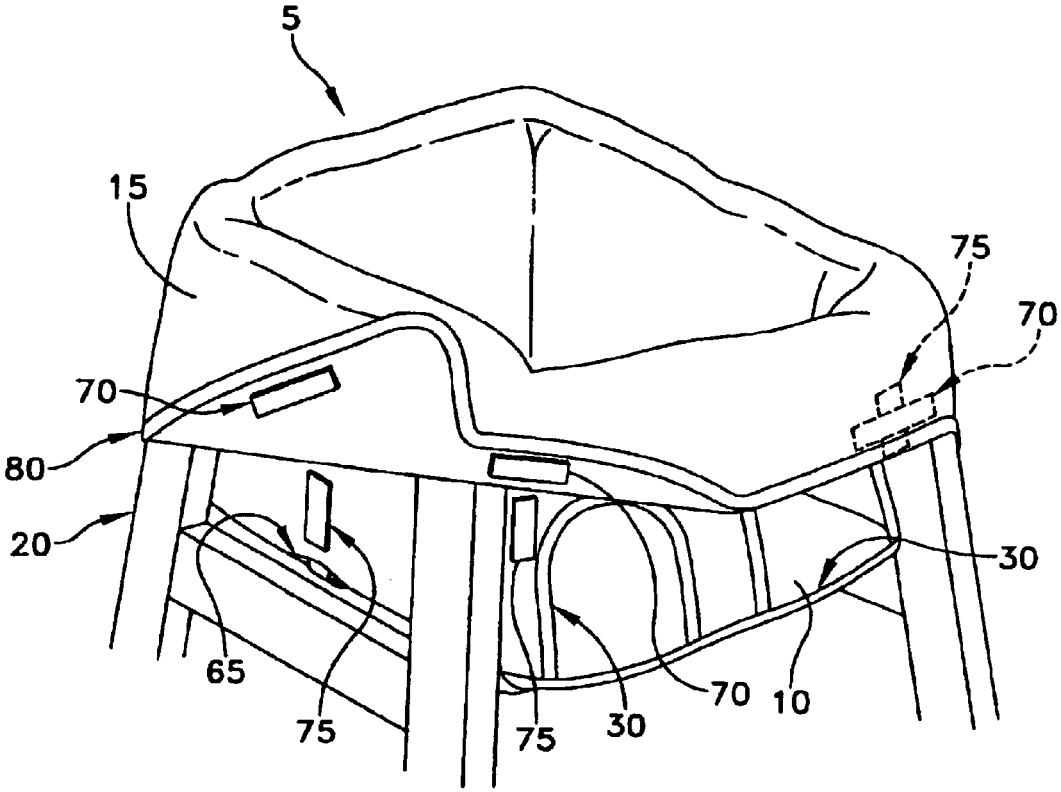
FIG. 4 is a schematic view illustrating Velcro® hook and loop fasteners disposed on the opposed surfaces of the continuous flap for adjustably securing the continuous flap in position on the high chair.
Figure 5:
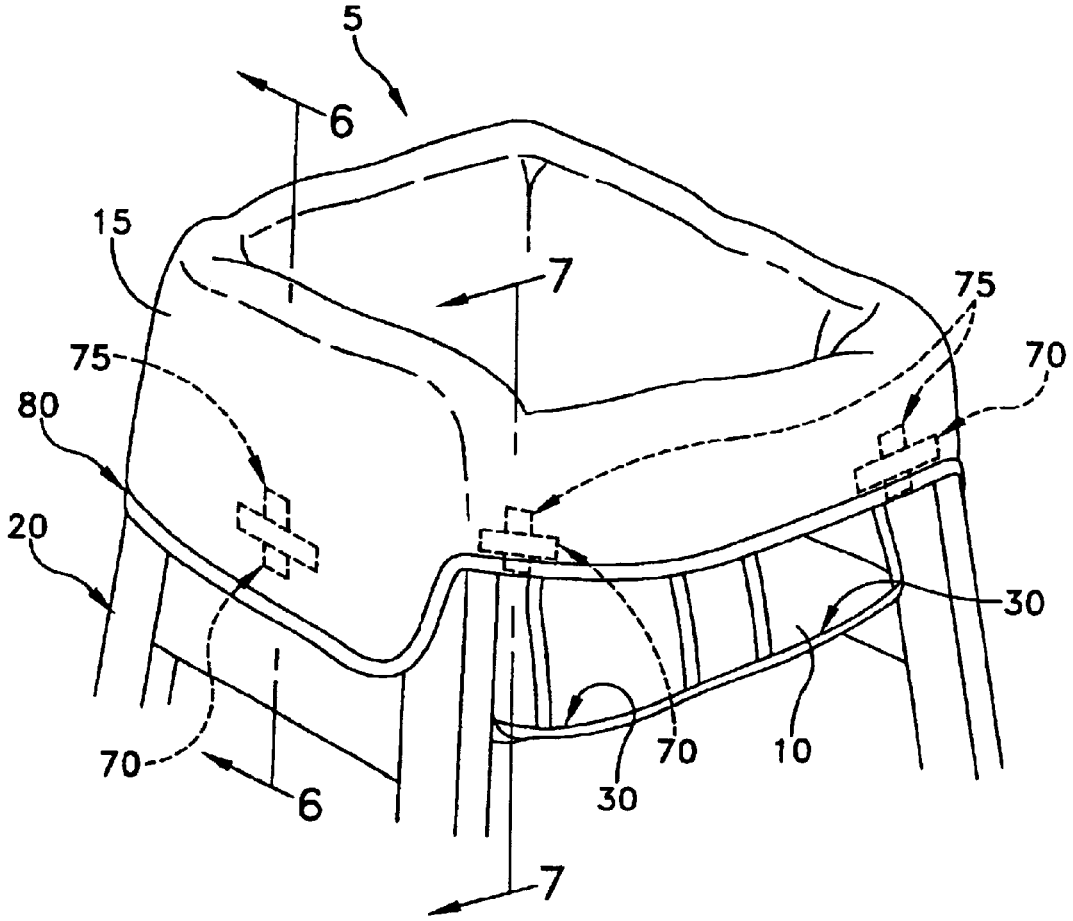
FIG. 5 is another diagrammatic illustration of the high chair seat cover shown in FIG. 1.
Figure 6:
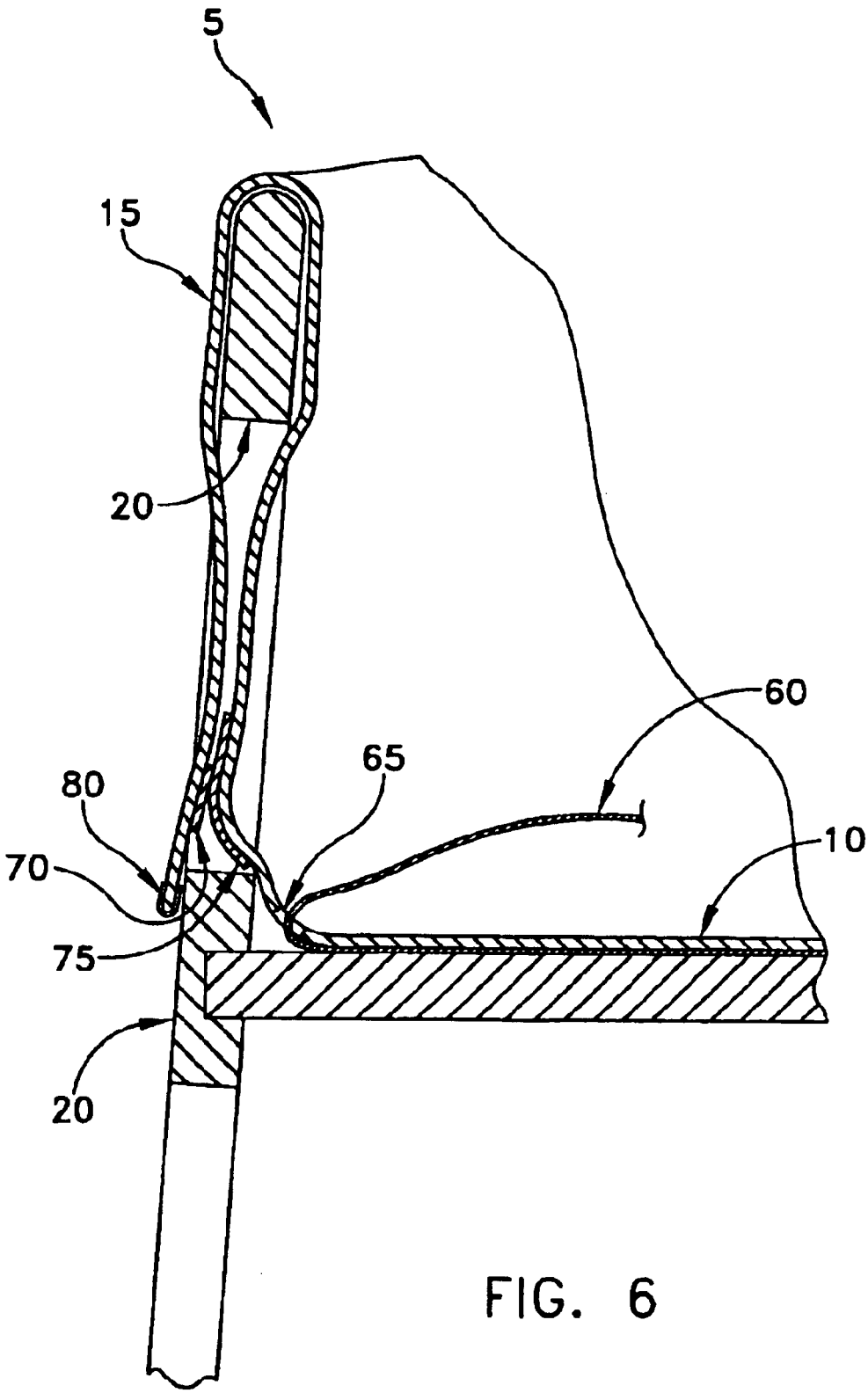
FIGS. 6 and 7 are schematic cross-sectional views of the seat cover shown in FIG. 5.
Figure 7:
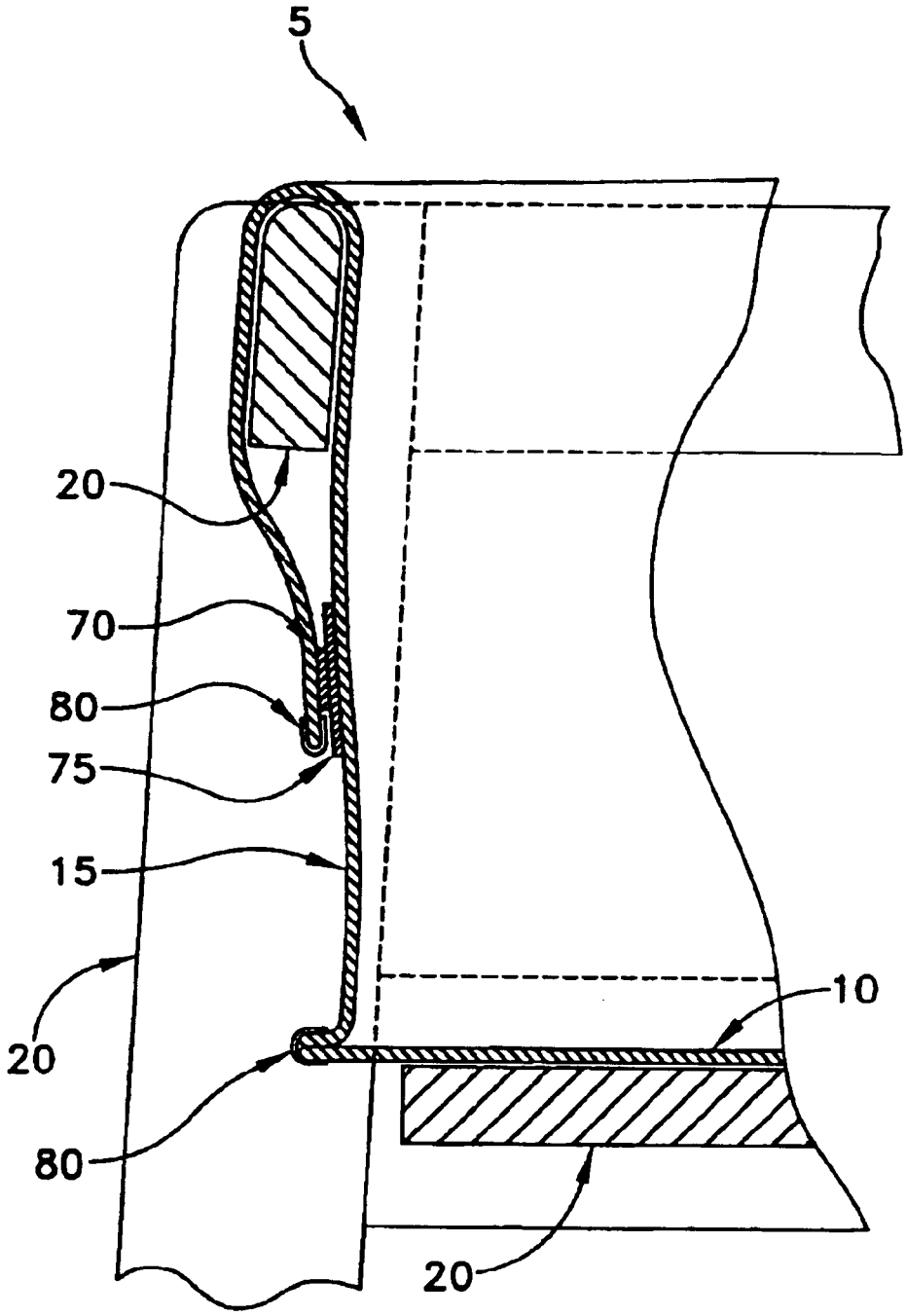

Looking now at FIG. 3, and in a preferred embodiment of the present invention, there is shown a safety belt 60. Safety belt 60 of the high chair seat cover 5 allows a baby or toddler 25 to sit more securely while eliminating any exposure to previously soiled straps provided on restaurant high chair 20. In a preferred embodiment of the present invention, high chair seat cover 5 is provided with slits 65 (FIGS. 4 and 6) for safety belt 60 to pass through.

Referring now to FIGS. 4–7, and in a preferred embodiment of the present invention, there is shown a continuous plication 15 folded over the upper periphery of high chair 20 so as to form an inwardly facing surface and an outwardly facing surface disposed toward one another. A first set of Velcro® hook and loop type fasteners 70 is disposed on the inwardly facing surface of continuous plication 15 and a second set of Velcro® hook and loop type fastener 75 is disposed on an outwardly facing surface of continuous plication 15. Individual pairs of fasteners 70 and fasteners 75 are disposed relative to one another so as to allow selective attachment of the portion of continuous plication 15 extending over the periphery high chair 20 to the portion of continuous plication 15 within the seating area. The individual pairs of fasteners 70 and fasteners 75 are attached together to secure high chair seat cover 5 to high chair 20.

Preferably, the individual pairs of fasteners 70 and fasteners 75 are oriented at an angle relative to one another such that high chair seat cover 5 is configured for attachment to various sized high chairs.

In a preferred embodiment of the present invention, high chair seat cover 5 is provided with a carry case for compact, convenient storage in a diaper bag, purse or seat pocket of a car or van.

In a preferred embodiment of the present invention, a piping material 80, for example, see FIGS. 1–7, is preferably provided to help retain high chair seat cover 5 in a formed shape. In turn, piping material 80 causes central portion 10 to be form fitting to high chair 20. Alternatively, central portion 10 may be configured to be form fitting without the use of any piping material.

Preferably, the novel high chair seat cover comprises washable material so as to allow the high chair seat cover to be laundered as often as they deem necessary. In an alternative preferred embodiment of the present invention, the novel high chair seat cover is constructed from disposable material and/or recycled material instead of washable material. For example, these materials may include vinyl, plastic, non-woven fabric, surgical gown or mask material so as to avoid liquid permeation.

In other preferred embodiments of the present invention, high chair seat cover 5 is held in position by one or more fasteners such as snaps, elastic or piping. These fasteners may be used in addition to, or instead of, Velcro® hook and loop fasteners.

In other preferred embodiments of the present invention, pockets are provided to hold toys, baby wipes, napkins, tissues or other small items.

One advantage of the present invention is that the high chair clean seat is configured to cover the entire seating area of a high chair, including the bottom, front, rear, sides, corners, and upper portions of each highchair leg. As such, there is a reduced exposure to bacteria and other disease-causing germs and viruses that lead to illness.

Another advantage of the present invention is that the one-piece construction of the high chair seat cover product allows installation using one hand, in less than 10 seconds.

And another advantage of the present invention is that the high chair clean seat cover is preferably configured for compact storage in a carry case. This carry case is sized to fit in a diaper bag or the seat pocket of a car or van.

Yet another advantage is the continuous sleeve enables the high chair seat cover to stay in place on the high chair and cannot be removed by a seated baby or toddler.

And yet another advantage of the present invention is that the high chair seat cover has a safety strap to enable babies and toddlers to sit more securely without using a previously soiled strap attached to the high chair.

Having described preferred embodiments of the invention with reference to the accompanying drawings, it is to be understood that the embodiments shown herein are by way of example, and that various changes and modifications may be effected by one skilled in the art without departing from the scope or spirit of the invention as defined in the following claims.

What is claimed is:

1. A high chair clean seat for use as a seat cover on a high chair, said high chair clean seat comprising:

a central portion forming a substantially horizontal floor having a perimeter, wherein said perimeter of said horizontal floor is configured for disposition within a horizontal seating surface of the high chair, and wherein said substantially horizontal floor of said central portion is configured to cover the horizontal seating surface of the high chair;

a continuous plication surrounding said central portion, said continuous plication having a front portion and a back portion extending substantially vertically from said perimeter of said central portion, respectively, said front portion having a first width substantially equal to a front area of the high chair, said back portion having a second width substantially equal to a second inside width of a back area of the high chair, said continuous plication having a first side portion and a second side portion extending substantially vertically from said perimeter of said central portion, respectively, said first side portion having a third width substantially equal to a third inside width of a first side area of the high chair, and the second side portion having a fourth width substantially equal to a fourth inside width of a second side area of the high chair, wherein said continuous plication is configured to extend in a continuous fashion from said front portion to said first side portion to said back portion to said second side portion to said front portion so as to completely cover interior portions of the front area, the back area, the first side area, and the fourth side area;

an inside section and an outside section formed by a fold of said continuous plication in each one of said front portion, said back portion, said first side portion, and said second side portion, respectively, an uninterrupted apex formed at said fold of said continuous plication having a first length along said front portion between said first side portion and said second side portion, a second length along said rear portion between said first side portion and said second side portion, and a third length along each of said first side portion and said second side portion between said front portion and said rear portion, said first length of said front portion configured to cover a front rail of the high chair, said second length of said rear portion configured to cover a seatback portion of the high chair, and said third length of each of said first side portion and said second side portion configured to cover a pair of side rails, wherein said uninterrupted apex covers an entire upper perimeter of the high chair;

a given area of said front portion of the continuous plication configured with the inside section extending a first distance from the floor portion adjacent said perimeter to said uninterrupted apex, with the outside portion extending a second distance from the uninterrupted apex to a peripheral end, and the second distance being less than the first distance so as to allow unimpeded access to leg openings formed through said outside portion of the front portion between the peripheral end of the outside section and said substantially horizontal floor; and a first inner surface and a first outer surface in opposition to one another on said inside section of each of said front portion, said back portion, said first side portion, and said second side portion, respectively, a second inner surface and a second outer surface in opposition to one another on said outside section of each of said front portion, said back portion, said first side portion, and said second side portion, respectively, wherein said second inner surface of the outside section and the first outer surface of the inside portion are selectively disposable toward one another for each of each of said front portion, said rear portion, said first side portion, and said second side portion, respectively, and a securing fastener is disposed on said inner surface of said outside section and on said outer surface of said inside section of at least one of said front portion, said rear portion, said first side portion, and said second side portion, respectively, so as to selectively secure said continuous plication to the high chair.

2. A high chair clean seat for use as a seat cover on a high chair according to claim 1 wherein the entire seating area surrounding the center portion of the high chair comprises a front seating portion, a back seating portion, side seating portions, and an upper portion of each high chair leg.

3. A high chair clean seat for use as a seat cover on a high chair according to claim 1 wherein said securing fastener comprises hook and loop closures.

4. A high chair clean seat for use as a seat cover on a high chair according to claim 1 further comprising a pair of horizontal adjustment flaps extending from a portion of said continuous plication, and further comprising adjustment fasteners disposed on each of said pair of horizontal adjustment flaps and on a portion of said outer surface of said continuous plication adjacent to said horizontal adjustment flaps.

5. A high chair clean seat for use as a seat cover on a high chair according to claim 4 wherein said adjustment fasteners comprise hook and loop closures.

6. A high chair clean seat for use as a seat cover on a high chair according to claim 1 further comprising a safety belt in attachment to said central portion so as to secure a child to said high chair clean seat.

7. A high chair clean seat for use as a seat cover on a high chair according to claim 6 wherein said safety belt is used instead of a belt provided in the high chair.

8. A high chair clean seat for use as a seat cover on a high chair according to claim 1 wherein said central portion and said continuous plication comprise a thin sheet of material.

9. A high chair clean seat for use as a seat cover on a high chair according to claim 8 wherein said thin sheet of flexible material comprises cotton quilted material.

10. A high chair clean seat for use as a seat cover on a high chair according to claim 8 wherein said thin sheet of flexible material comprises a polyester and cotton blend material.

11. A high chair clean seat for use as a seat cover on a high chair according to claim 8 wherein said thin sheet of flexible material comprises an outer portion of cotton material and an inner portion of polyester material.

12. A high chair clean seat for use as a seat cover on a high chair according to claim 8 wherein said thin sheet of flexible material comprises a plastic material.

13. A high chair clean seat for use as a seat cover on a high chair according to claim 8 wherein said thin sheet of flexible material comprises a non-woven fabric.

14. A high chair clean seat for use as a seat cover according to said thin claim 8 wherein said thin sheet of flexible material comprises a recycled material.

15. A high chair clean seat for use as a seat cover on a high chair according to claim 8 wherein said thin sheet of flexible material comprises a disposable material.

16. A high chair clean seat for use as a seat cover on a high chair according to claim 1 wherein said central portion and said continuous plication are integral.

17. A high chair clean seat for use as a seat cover on a high chair according to claim 1 further comprising piping material attached to said central portion and said continuous plication so as to retain a formed shape.

18. A high chair clean seat for use as a seat cover on a high chair according to claim 1 wherein said front portion of said continuous plication defines a pair of leg openings therethrough.

19. A high chair clean seat for use as a seat cover on a high chair according to claim 1 wherein said continuous plication comprises an outer perimeter forming a generally rectangular shape so as to fit directly over an outer perimeter of the high chair.

20. A high chair clean seat for use as a seat cover on a high chair according to claim 19 wherein said generally rectangular shape is square.

21. A method for covering an entire seating area of a high chair, the method comprising:

providing a high chair clean seat for use as a seat cover on the high chair, said high chair clean seat comprising:

a central portion forming a substantially horizontal floor having a perimeter, wherein said perimeter of said horizontal floor is configured for disposition within a horizontal seating surface of the high chair, and wherein said substantially horizontal floor of said central portion is configured to cover the horizontal seating surface of the high chair;

a continuous plication surrounding said central portion, said continuous plication having a front portion and a back portion extending substantially vertically from said perimeter of said central portion, respectively, said front portion having a first width substantially equal to a front area of the high chair, said back portion having a second width substantially equal to a second inside width of a back area of the high chair, said continuous plication having a first side portion and a second side portion extending substantially vertically from said perimeter of said central portion, respectively, said first side portion having a third width substantially equal to a third inside width of a first side area of the high chair, and the second side portion having a fourth width substantially equal to a fourth inside width of a second side area of the high chair, wherein said continuous plication is configured to extend in a continuous fashion from said front portion to said first side portion to said back portion to said second side portion to said front portion so as to completely cover interior portions of the front area, the back area, the first side area, and the fourth side area;

an inside section and an outside section formed by a fold of said continuous plication in each one of said front portion, said back portion, said first side portion, and said second side portion, respectively, an uninterrupted apex formed at said fold of said continuous plication having a first length along said front portion between said first side portion and said second side portion, a second length along said rear portion between said first side portion and said second side portion, and a third length along each of said first side portion and said second side portion between said front portion and said rear portion, said first length of said front portion configured to cover a front rail of the high chair, said second length of said rear portion configured to cover a seatback portion of the high chair, and said third length of each of said first side portion and said second side portion configured to cover a pair of side rails, wherein said uninterrupted apex covers an entire upper perimeter of the high chair;

a given area of said front portion of the continuous plication configured with the inside section extending a first distance from the floor portion adjacent said perimeter to said uninterrupted apex, with the outside portion extending a second distance from the uninterrupted apex to a peripheral end, and the second distance being less than the first distance so as to allow unimpeded access to leg openings formed through said outside portion of the front portion between the peripheral end of the outside section and said substantially horizontal floor; and a first inner surface and a first outer surface in opposition to one another on said inside section of each of said front portion, said back portion, said first side portion, and said second side portion, respectively, a second inner surface and a second outer surface in opposition to one another on said outside section of each of said front portion, said back portion, said first side portion, and said second side portion, respectively, wherein said second inner surface of the outside section and the first outer surface of the inside portion are selectively disposable toward one another for each of each of said front portion, said rear portion, said first side portion, and said second side portion, respectively, and a securing fastener is disposed on said inner surface of said outside section and on said outer surface of said inside section of at least one of said front portion, said rear portion, said first side portion, and said second side portion, respectively, so as to selectively secure said continuous plication to the high chair; and positioning said high chair clean seat on the entire seating area of the high chair by placing said central portion, said front portion of said continuous plication, said back portion of said continuous plication, said first side portion of said continuous plication, and said second side portion of said continuous plication over the center seating portion of the high chair, a front portion of the high chair, a back portion of the high chair, a first side portion of the high chair, and a second side portion of the high chair, respectively, so as to cover the entire seating area of the high chair with said high chair clean seat.

22. A method for covering an entire seating area of a high chair according to claim 21 wherein the entire seating area further comprises an upper portion of each high chair leg, and wherein said continuous plication covers said upper portion of each high chair leg.

* * * * *